US011933016B2

(12) United States Patent
Hampson et al.

(10) Patent No.: US 11,933,016 B2
(45) Date of Patent: Mar. 19, 2024

(54) BUCKET AND METHOD OF CONSTRUCTION THEREOF

(71) Applicant: Mainetec Pty Ltd, Paget (AU)

(72) Inventors: Brett Ashley Hampson, Paget (AU); Stephen Mounsey, Paget (AU)

(73) Assignee: Mainetec Pty Ltd, Paget (AU)

( * ) Notice: Subject to any disclaimer, the term of this patent is extended or adjusted under 35 U.S.C. 154(b) by 134 days.

(21) Appl. No.: 17/342,427

(22) Filed: Jun. 8, 2021

(65) Prior Publication Data

US 2021/0388574 A1 Dec. 16, 2021

(30) Foreign Application Priority Data

Jun. 10, 2020 (AU) ..... 2020100978

(51) Int. Cl.
*E02F 3/40* (2006.01)
*E02F 3/14* (2006.01)

(52) U.S. Cl.
CPC ..... *E02F 3/40* (2013.01); *E02F 3/141* (2013.01)

(58) Field of Classification Search
CPC . E02F 3/40; E02F 3/401; E02F 3/8152; E02F 3/141
See application file for complete search history.

(56) References Cited

U.S. PATENT DOCUMENTS 2,034,854 A * 3/1936 Lewis ..... E02F 3/40 414/722
2,926,800 A * 3/1960 Paul, V ..... E02F 3/40 37/444
5,063,694 A * 11/1991 McCreary, Jr. ..... E02F 3/40 37/444
5,267,402 A * 12/1993 Russell ..... E02F 3/40 37/379
8,069,593 B2 * 12/2011 McClallen ..... E02F 3/40 37/444
9,428,881 B1 * 8/2016 Chabura ..... E02F 3/40
9,957,689 B2 * 5/2018 Rochel ..... E02F 3/40
2017/0037597 A1 * 2/2017 McLoughlin ..... E02F 3/962
2020/0283990 A1 * 9/2020 Clearman ..... E02F 3/40

FOREIGN PATENT DOCUMENTS

WO WO-2018213863 A1 * 11/2018 ..... E02F 3/40

* cited by examiner

*Primary Examiner* — Jessica H Lutz
*Assistant Examiner* — Blake E Scoville
(74) *Attorney, Agent, or Firm* — Weisun Rao; Jun Chen; Venture Partner, LLC

(57) ABSTRACT

The present invention concerns a bucket, an excavator including the bucket and method of construction of the bucket. In one form, the bucket includes an attachment portion for attachment of the bucket to the machine; and a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion. The bucket further includes a reinforcing formation extending across an outer surface of the top wall and at least an adjacent portion of each sidewall of the containment portion, said reinforcing formation having an arcuate shape that transitions into, and at least partially defines, a corner between the top wall and each sidewall to reinforce a join between the top wall and the sidewall and enhance rigidity of the bucket.

18 Claims, 5 Drawing Sheets

BUCKET AND METHOD OF CONSTRUCTION THEREOF

CROSS-REFERENCE TO RELATED APPLICATION

This application claims the benefit of Australian Innovation Patent Application No. 2020100978, filed on Jun. 10, 2020, which is incorporated by reference herein in its entirety.

TECHNICAL FIELD

The present invention relates to mining and excavation equipment for moving materials. In particular, the present invention concerns a bucket, an excavator and/or a loader including the bucket and a method of construction of the bucket.

BACKGROUND

Buckets are commonly associated with excavators, bull dozers, power shovels, bucket wheels, dredgers, draglines, backhoes and other like heavy equipment for use in loading, unloading and transporting materials, such as, e.g., earthen material. Typically, such buckets include a part that interacts with a bucket handling arrangement on a machine and a containment portion for receiving, unloading and transporting the materials.

Usually, such buckets are constructed using quenched and tempered steel plates that are supplied flat, formed into a desired shape and then welded together to form the bucket. A problem in general with this process is that the steel plates have a maximum pressing radius and certain shapes are not achievable. Accordingly, the steel plates are often welded in critical areas of high stress, which adversely affects the structural strength of the bucket since the strength is directed related to the strength of the weld.

Conventional practice is to compensate for such weaknesses through the application of liner plates, internal gussets and torque tubes along internal welds. However, this reduces bucket capacity and adds to the weight of the bucket, which, in turn, delays operation time and burns more fuel thereby adding to operation costs.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a bucket and method of construction thereof, which may at least partially address one or more of the problems or deficiencies mentioned above or which may provide the public with a useful or commercial choice.

According to a first aspect of the present invention, there is provided a bucket for use with a machine, said bucket including:

- an attachment portion for attachment of the bucket to the machine;
- a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion; and
- at least one reinforcing formation extending across an outer surface of the top wall and at least an adjacent portion of each sidewall of the containment portion, said reinforcing formation having an arcuate shape that transitions into, and at least partially defines, a corner between the top wall and each sidewall to reinforce a join between the top wall and the sidewall and enhance rigidity of the bucket.

According to a second aspect of the present invention, there is provided a reinforcing formation for use with a bucket, said reinforcing formation configured to extend across an outer surface of a top wall and at least an adjacent portion of each sidewall of a containment portion of a bucket, said reinforcing formation having an arcuate shape that transitions into, and at least partially defines, a corner between the top wall and each sidewall to reinforce a join between the top wall and the sidewall and enhance rigidity of the bucket.

According to a third aspect of the present invention, there is provided an excavator including:

- a moveable support having ground engaging formations;
- an articulating member including a boom extendable from the moveable support and a dipper extending from a remote end of the boom; and
- a bucket in accordance with the first aspect, wherein the attachment portion is mounted by a mounting arrangement on an end of the articulating member.

According to a fourth aspect of the present invention, there is provided a loader including:

- a moveable support having ground engaging formations;
- at least one loader lift arm extendable from the moveable support; and
- a bucket in accordance with the first aspect, wherein the attachment portion is mounted by a mounting arrangement on an end of the at least one loader lift arm.

Advantageously, the at least one reinforcing formation of the present invention enables the bucket to have substantially the same structural strength as existing buckets but without an increase in weight and reduction in capacity due to the application of liner plates, internal gussets and torque tubes along the internal welds as found in conventional buckets. In turn, this enables the bucket of the present invention to move more material in a faster and more efficient manner than conventional buckets and thereby reduce overall operating costs.

As indicated above, the bucket of the present invention is for use in the loading, unloading and transporting materials, preferably earthen materials. It will therefore be convenient to hereinafter describe the bucket with reference to this example application as an excavator or loader bucket. However, a person skilled in the art will appreciate that the bucket is capable of broader applications and applies to other buckets and machines for material handling.

The bucket may be of any suitable size, shape and construction and formed from any suitable material or materials for the loading, unloading and transport of materials, preferably earthen materials.

Generally, the bucket may be formed from metal material or materials, preferably hardened steel plates, such as, e.g., quenched and tempered steel plate. The bucket may be of unitary construction or may be formed from two or more bucket pieces, preferably the latter.

The earthen materials may include soil, earth, post blast overburden, loose overburden, coal, metalliferous ore and the like, for example.

As indicated, the bucket includes an attachment portion for attachment of the bucket to a machine and a containment portion mounted to the attachment portion for receiving, holding and unloading the materials.

The machine to which the bucket is mounted may be any suitable machine used for moving earth or ground material, such as, e.g., excavators, draglines, bulldozers, dredgers, rope shovel dippers, bucket wheels and front-end loaders.

As indicated, the containment portion is defined by a base wall, an opposed top wall, a pair of opposed sidewalls and a rear wall. Each of the base wall, the top wall and the opposed sidewalls has an outer edge and extends from the rear wall to the outer edge to define an opening for to the containment portion for receiving and unloading materials to and from the containment portion.

Each wall may include a pair of opposed surfaces, including an inner surface and an opposed outer surface. The opposed surfaces may extend substantially parallel to one another.

The outer edge of the base wall may include one or more ground engaging teeth spaced at least partially along a length of the edge. The teeth may be configured to be removably attached to the edge for replacement as needed.

In some embodiments, the outer edge of the base wall may also include one or more lip shrouds spaced at least partially along the length of the edge between the teeth. Like the teeth, the one or more shrouds may be configured to be removably attached to the edge for replacement as needed.

The outer edges of any one of the sidewalls and the top wall may be appropriately reinforced or provided with wear resistant facing or components.

For example, one or both sidewalls may include one or more wing shrouds and/or side cutters fastened to each edge to protect the edge from wear and/or facilitate excavation of materials. Like with the teeth and lip shrouds, the wing shrouds and side cutters may be configured to be removably attached for replacement as needed.

In some embodiments, the outer surfaces of one or more of the rear walls and the base wall may be appropriately reinforced or provided with wear resistant facing or components. For example, one or both of the rear wall and the base wall may include one or more heel shrouds and wear plates fastened along side edges and the outer surface to protect the edges and the surface from wear.

The base wall, the top wall and the sidewalls extend rearwardly from the opening to the rear wall. The base wall, the top wall and the sidewalls may extend rearwardly from the opening to the rear wall in any suitable way.

For example, the walls may extend in a linear or curvilinear manner.

In some embodiments, the base wall, the top wall and the sidewalls may taper or converge inwards as they extend rearwardly. In such embodiments, at least the sidewalls may extend from the rear wall at an obtuse angle relative to the rear wall.

In other embodiments, the base wall, the top wall and the sidewalls may diverge outwards as they extend rearwardly. In such embodiments, at least the sidewalls may extend from the rear wall at an acute angle relative to the rear wall.

In yet other embodiments, at least the sidewalls may orthogonally extend from the rear wall to the opening.

Normally, the sidewalls may be substantially planar. In some embodiments, the top wall and the base wall may also be substantially planar. In other embodiments, the top wall and the base wall may be curved or partially curved.

The rear wall of the bucket may be curved, preferably arcuate in at least one dimension. The rear wall may be curved to any degree. For example, the rear wall may be defined by a constant or uniformly changing radius or some other suitable curve.

In preferred embodiments, the top wall and the base wall may curve rearwardly and at least partially define a cylindrical surface together with the rear wall. The top wall, the base wall and the rear wall may be formed from one or more plates suitably pressed to define the respective walls.

The containment portion of the bucket may include rounded corners extending between adjacent walls/sidewalls.

The base wall, the top wall and the rear wall may join to the sidewall in any suitable way. For example, the base wall, the top wall and the rear wall may be joined to each sidewall either directly or indirectly.

Any suitable type of join may be used.

In some embodiments, the edges of the base wall, the top wall and the rear wall may include one of a female or male formation and the edges of each sidewall may include the other of the female or male formation. The female and male formations may mate, or engage, with one another join the respective walls.

In some embodiments, the edges of the respective walls may be joined together via a joining component adapted to be operatively associated with each edge to be joined. Each join may include one or more joining components.

In some embodiments, the edges of the respective walls may be joined together using conventional welding techniques.

In other embodiments, the edges of the respective walls may be joined together using one or more mechanical fasteners.

In yet other embodiments, the edges of the walls may be joined or connected together by a connecting mechanism or part of a connecting mechanism. For example, a first part of the connecting mechanism associated with an edge of a wall or sidewall may mate, or engage with, a second part of the connecting mechanism associated with another edge of an adjacent wall or sidewall.

The connecting mechanism may include a threaded connection, an interference fit (snap fit) connection or a bayonet-type connection, for example.

The connecting mechanism may include a male formation engaging with a female formation. For example, in one such embodiment, the connecting mechanism may include a male formation associated with a first edge of a wall or sidewall that engages with or is at least partially received in a female formation associated with another edges of a wall or sidewall.

In preferred embodiments, the edges of the base wall, the top wall and the rear wall may be joined to an adjacent edge of a sidewall with a joining component, preferably in the form of one or more liner plates and/or gussets welded externally at least partially along or over the join.

One or more of the walls may be manufactured by more than one component attached together, or may be a substantially unitary component. Preferably, joins between wall components may be smooth and flush with the inner surface to minimise any well-defined joins.

In providing the joins as described above, the base wall, the top wall, the sidewalls and the rear wall may advantageously together define a linerless internal containment portion.

In some embodiments, the profile of the containment portion may be different on the inside to that of the outside shape of the bucket.

As indicated, the bucket includes an attachment portion for attachment of the bucket to a machine. The attachment portion may be of any suitable size, shape and construction for attachment to a mounting arrangement operatively associated with the machine.

The attachment portion may typically take the form of one or more pairs of attachment flanges with one or more openings defined in each flange for receiving at least one pin between each pair.

The containment portion may be mounted to the attachment portion in any suitable way. Normally, the attachment portion may be mounted to an outer surface of the top wall of the containment portion of the bucket, but may extend rearwardly at least partially over the rear wall.

In some embodiments, the containment portion and the attachment portion may be of unitary construction.

In other embodiments, the attachment portion may be joined to the containment portion. The attachment portion may be fixedly or detachably joined to the containment portion for example.

In some embodiments, the attachment portion and the containment portion may be permanently joined together using conventional welding techniques.

In other embodiments, the attachment portion may be fastened to the containment portion by one or more mechanical fasteners.

In yet other embodiments, the attachment portion and the containment portion may be connected together by a connecting mechanism or part of a connecting mechanism. The connecting mechanism may include a first part associated with the attachment portion, which may mate with or engage with a second part of the connecting mechanism associated with the containment portion.

The connecting mechanism may include a threaded connection, an interference fit (snap fit) connection or a bayonet-type connection, for example.

The connecting mechanism may include a male formation engaging with a female formation as previously described.

The containment portion may include strengthening ribs or formations for imparting greater structural rigidity to the bucket and the containment portion.

For example, in some embodiments, the bucket may include one or more liner plates and/or gussets welded internally or externally a top of joins, preferably externally.

In other embodiments, the bucket may include one or more reinforcing torque tubes extending internally or externally along one or more of the walls, preferably externally.

As indicated, the bucket includes a reinforcing formation extending across an outer surface of the top wall and at least an adjacent portion of each sidewall of the containment portion.

The reinforcing formation may be of any suitable size, shape and construction to enhance the rigidity of the bucket and reinforce at least a join between the top wall and each sidewall.

The reinforcing formation may be formed from metal material or materials, preferably hardened steel. The reinforcing formation may be of separate construction and may be mounted to the outer surface of the top wall and a portion of each sidewall, although a reinforcing formation of unitary construction with the bucket is also envisaged.

The reinforcing formation may be of unitary construction or may be formed from two or more reinforcing formation pieces, preferably the latter.

The reinforcing formation may be of tubular or solid construction, typically tubular with a substantially D-shaped cross-section.

In some embodiments, the reinforcing formation may include a bucket abutting wall and an arcuate outer wall. The bucket abutting wall and the arcuate outer wall may be interconnected by opposing edges, including opposed end edges and opposed side edges extending longitudinally between the opposed end edges.

The bucket abutting wall may be substantially planar.

The arcuate outer wall may be arcuate in at least one dimension, preferably between the opposed side edges. The arcuate outer wall may be curved to any degree. For example, the arcuate outer wall may be defined by a constant or uniformly changing radius or some other suitable curve.

In some embodiments, the arcuate outer wall and one or both side edges may interconnect in a flush join.

In other embodiments, one or both of the opposed side edges may protrude outwardly past an interconnection with the arcuate outer wall.

An outer surface of the bucket abutting wall may be configured to be attached to an outer surface of top wall of the containment portion of the bucket in any suitable way, typically in a surface-to-surface arrangement.

In some embodiments, the surfaces may be fixedly or detachably joined, for example.

In some such embodiments, the outer surfaces of the top wall and the reinforcing formation may be permanently joined together using conventional welding techniques.

In other embodiments, the outer surfaces of the top wall and the reinforcing formation may be fastened together by one or more mechanical fasteners.

In yet other embodiments, the outer surfaces of the top wall and the reinforcing formation may be connected together by a connecting mechanism or part of a connecting mechanism as previously described.

In preferred embodiments, the reinforcing formation may have rounded and/or tapered end portions that transition into and at least partially wrap around a corner defined between the top wall and each sidewall of the containment portion of the bucket, preferably rounded. In at least partially wrapping around each corner, the reinforcing formation may advantageously bolster the join between the top wall and each side wall and/or enhance the structural rigidity of the bucket.

The end portions may be rounded to any degree. For example, the rounded corner defined by each end portion may be defined by a constant or uniformly changing radius or some other suitable curve.

In some embodiments, the reinforcing formation may have at least one rounded and/or tapered side edge portion that transition into, and at least partially defines a join or transition between the top wall and the rear wall. In at least partially defining a join or transition between the top wall and the rear wall, the reinforcing formation may advantageously bolster the join between the top wall and rear wall and/or enhance the structural rigidity of the bucket.

In some embodiments, the reinforcing formation may include at least one internal support member extending between inner surfaces of the bucket abutting wall and the arcuate outer wall. The at least one internal support member may extend longitudinally at least partially along a length of the reinforcing formation. In some such embodiments, the at least one internal support member may extend continuously. In other such embodiments, a plurality of internal support members may extend longitudinally at periodic intervals along the length of the reinforcing formation.

Typically, the internal support may be centrally positioned, preferably extending between the apex of the arcuate outer wall and a point mid-way between the opposed side edges of the bucket abutting wall.

The shape of the reinforcing formation provides many benefits. For example, the radius of curvature of the end portions enhances the structural rigidity of the bucket, particular in relation to the join between the top wall and sidewalls of the containment portion. The internal support member enhances the strength of the reinforcing formation and the bucket during its highest break out force.

Further, in some embodiments, the reinforcing formation is configured to interconnect the attachment portion and the containment portion. In such an arrangement, the reinforcing formation reduces stress applied by an associated machine on the bucket and enhances the structural rigidity of the bucket.

In some embodiments, the reinforcing formation may be formed from two or more reinforcing formation portions. For example, the reinforcing formation may be formed from two, three, four or even five reinforcing formation portions joined together, preferably longitudinally in an end-to-end arrangement.

In preferred embodiments, the reinforcing formation may include a central portion having a pair of opposed ends and configured to extend at least partially across an outer surface of the top wall and pair of end portions each configured to join to an end of the central portion and extend across a portion of the outer surface of the top wall and at least an adjacent portion of each sidewall of the containment portion.

The reinforcing formation portions may be joined together in an end-to-end arrangement in any suitable way. For example, the portions may be joined together either directly or indirectly.

Any type of join may be used. If directly joined together, the join may be a butt joint, a mitre joint, a lap joint, a box joint, a dovetail joint, a daddo joint or a mortice and tenon joint.

In some embodiments, the ends of the portions being joined together may include a female formation and a male formation. The female and male formations may mate, or engage, with one another to join or connect the portions together.

In some embodiments, the portions may join together in an end-to-end arrangement via a joining component adapted to be operatively associated with the ends of the portions being joined together. Each join may include one or more joining components.

In some embodiments, the portions may be joined together using conventional welding techniques.

In other embodiments, the portions may be joined together using one or more mechanical fasteners.

In yet other embodiments, the portions may be joined or connected together by a connecting mechanism or part of a connecting mechanism as previously described. For example, a first part of the connecting mechanism associated with an end of the central portion may mate, or engage with, a second part of the connecting mechanism associated with an end portion.

In preferred embodiments, an end of each end portion may include a recess defined in the bucket abutting wall and each end of the central portion may include a protruding portion of the bucket abutting wall configured to be at least partially received in the recess and at least partially underlie an adjacent end portion when joined together.

In some embodiments, the at least one reinforcing formation may further include one or more tether points for in use tethering a load to the bucket and/or handling the bucket when not attached to a machine.

The one or more tether points may be of any suitable size, shape and construction and may be located in any suitable location on the at least one reinforcing formation.

Typically, the one or more tether points may take the form of a flange with a central opening or a loop protruding outwardly from an outer surface of the reinforcing formation.

The one or more tether points may preferably be located at or near each end of the reinforcing formation located on the outer surface of the top wall of the bucket.

Advantageously, by having the one or more tether points protrude from the reinforcing formation, stress on the individual tether points and ears of the bucket is reduced thereby enhancing the overall rigidity of the bucket.

In some embodiments, one or both sidewalls of the containment portion of the bucket may include at least one recessed or stepped portion for at least providing the sidewalls with greater rigidity.

The at least one recessed or stepped portion may preferably be a recessed portion provided or defined on the inner surface of the sidewalls.

The at least one recessed portion may be of any suitable size, shape and form and may be located in any suitable located on the inner surface of the sidewalls, preferably the same location on both sidewalls.

For example, in some embodiments, the recessed portion may be located on each sidewall at or near a join with one or more of the rear wall, the top wall and the base wall.

In other embodiments, the recessed portion may be located at or near the outer edge of each sidewall.

In preferred embodiments, the recessed portion may be located at or near a rear of each sidewall, typically adjacent a join with one or more of the rear wall, the base wall and the top wall. Preferably, each sidewall may include a thickened or non-recessed portion at and adjacent the outer edge or cheek of the sidewall.

Each sidewall may further include a transition between a recessed rear portion and a non-recessed outer portion. The transition may be of any suitable shape.

For example, in some embodiments, the transition between the non-recessed outer portion and the recessed rear portion may be clearly delineated by a defined step or ridge or the like.

In other preferred embodiments, the transition may include a gradual taper between the non-recessed outer portion and the recessed rear portion of each sidewall. The taper may be of any suitable gradient and may be linear or non-linear, preferably linear.

Advantageously, the at least one recessed portion may increase the capacity of the containment portion and the fill rate of the bucket. Further, the at least one recessed portion by expanding at least a portion of the sidewalls may reduce friction between each sidewall and the load material as the bucket is filled thereby increasing the life of the bucket.

According to a fourth embodiment of the present invention, there is provided a bucket for use with a machine, said bucket including:

an attachment portion for attachment of the bucket to the machine; and a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion, wherein one or both said sidewalls includes a recessed rear portion located adjacent a join with one or more of the base wall, the top wall and the rear wall and a non-recessed portion at and adjacent the outer edge of the one or both said sidewalls.

The bucket may include one or more characteristics or features of the bucket as hereinbefore described.

For example, the bucket may preferably include at least one reinforcing formation configured to extend across an outer surface of a top wall and at least an adjacent portion of each sidewall of the containment portion of the bucket. The reinforcing formation may have an arcuate shape that transitions into, and at least partially defines, a corner between the top wall and each sidewall to reinforce the join between the top wall and the sidewall and enhance rigidity of the bucket.

According to a fifth aspect of the present invention, there is provided a method of constructing a bucket in accordance with the first or the fourth aspect, said method including:

forming at least one plate member to define the top wall, the rear wall and the bottom wall of the bucket;

joining side plates to outer side edges of the at least one plate member to define the sidewalls of the bucket; and attaching the reinforcing formation to an outer surface of the top wall such that it extends across an outer surface of the top wall and at least an adjacent portion of each sidewall of the containment portion and transitions into, and at least partially defines, a corner between the top wall and each sidewall to reinforce the join between the top wall and the sidewall and enhance rigidity of the bucket.

The method may include one or more characteristics or features of the bucket and the reinforcing formation as hereinbefore described.

The forming may normally include forming at least two plate members in a side edge-to-side edge arrangement to define the top wall, the rear wall and the bottom wall of the bucket.

The adjacent side edges of the at least two plate members may be joined together using conventional welding techniques.

The joining may include joining each side plate to the at least one plate member in a side edge-to-side edge join with one or more joining components. Any suitable joining component may be used. In preferred embodiments, the joining component may include one or more liner plates and/or gussets externally applied at least partially along or over the respective edges of the side plate and the plate member forming the join. The joining component may be applied at least partially along or over the join using conventional welding techniques.

The attaching may include attaching the reinforcing formation to an outer surface of the top wall and at least a portion of each side wall in a surface-to-surface arrangement, preferably using conventional welding techniques.

In preferred embodiments, the reinforcing formation may further at least partially define a transition between the top wall and the rear wall of the containment portion.

Advantageously, the reinforcing formation may externally cover and bolster any join between longitudinal side edges of the at least one plate member and other like plate members and between the at least one plate member and each side plate thereby enhancing the structural rigidity of the bucket.

In some embodiments, the attaching may further include assembling the reinforcing formation by joining two or more reinforcing formations longitudinally together to assemble the reinforcing formation for attachment to the outer surface of the top wall and sidewalls of the containment portion.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION

FIGS. 1 to 6 show a bucket (100) and components thereof according to an embodiment of the present invention for use with a machine, such as, e.g., an excavator or loader.

Figure 1:
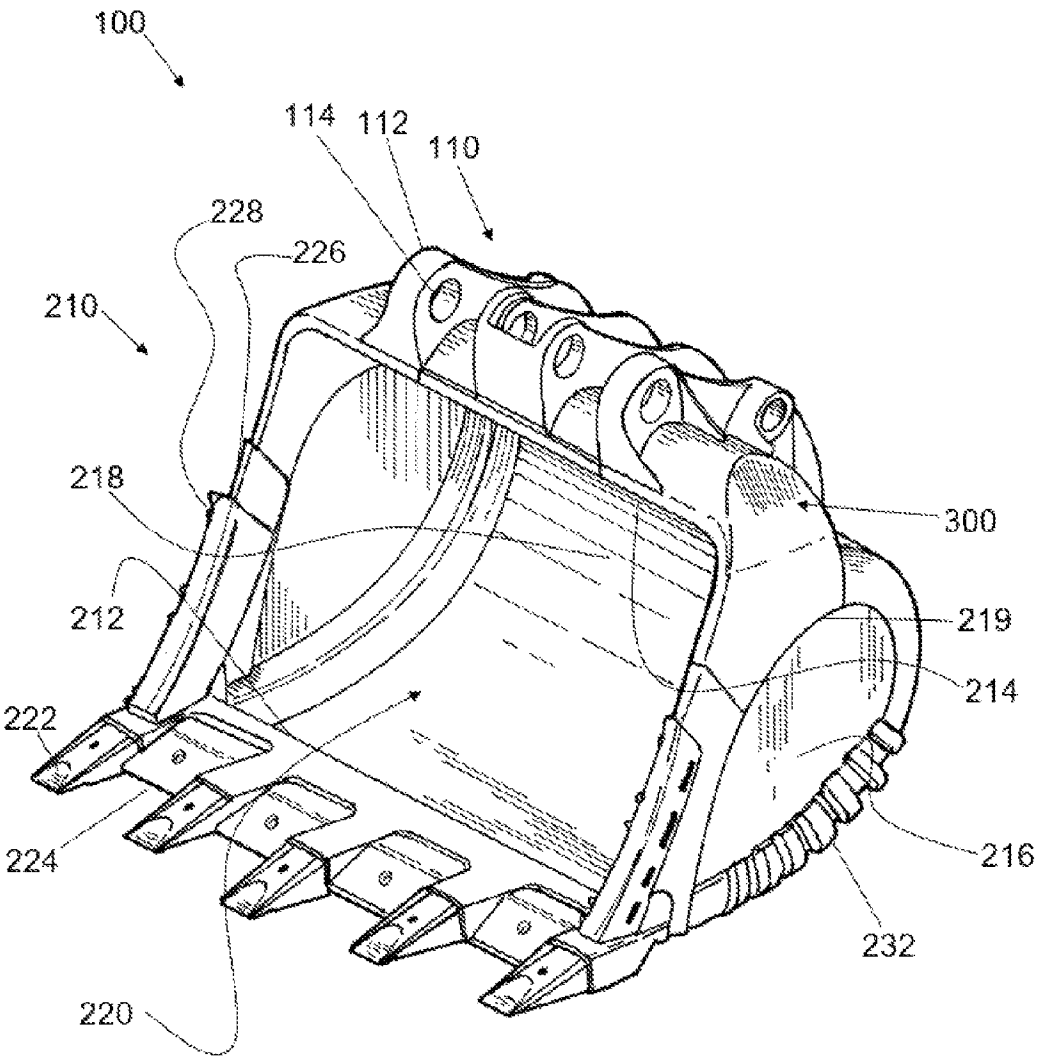
FIG. 1 is a photograph showing an upper perspective view of a bucket according to an embodiment of the present invention including a reinforcing formation extending across an outer surface of a top wall of the bucket.

Referring to FIG. 1, the bucket (100) includes an attachment portion (110) for attachment of the bucket (100) to a machine (not shown) and a containment portion (210) mounted to the attachment portion for receiving, transporting and unloading materials, such as, e.g., earthen materials.

The containment portion (210) is defined by a base wall (212), an opposed top wall (214), a pair of opposed sidewalls (216) and a rear wall (218). Each of the base wall (212), the top wall (214) and the sidewalls (216) has an outer edge (219) and extends from the rear wall (218) to the outer edge (219) to define an opening (220) for the receiving and unloading of materials.

The bucket (100) further includes a reinforcing formation (300) extending across an outer surface of the top wall (214) and an adjacent portion of each sidewall (216) of the containment portion (210). The reinforcing formation (300) has an arcuate shape that transitions to and defines a corner between the top wall (214) and each sidewall (216) to reinforce a join between the top wall (214) and the sidewall (216) and enhance the rigidity of the bucket (100).

The bucket (100) is formed from quenched and tempered steel plate.

Each wall (212, 214, 216, 218) includes a pair of opposed surfaces, including an inner surface and an opposed outer surface. The opposed surfaces extend substantially parallel to one another.

The outer edge (219) of the base wall (212) includes one or more ground engaging teeth (222) spaced at least partially along a length of the edge (219). The teeth (222) are configured to be removably attached to the edge (219) for replacement as needed.

The outer edge (219) of the base wall (212) also includes one or more lip shrouds (224) spaced at least partially along the length of the edge (219) between the teeth (222). Like the teeth (222), the one or more shrouds (224) are configured to be removably attached to the edge (219) for replacement as needed.

The outer edges (219) of the sidewalls (216) include one or more wing shrouds (226) and/or side cutters (228) fastened to each edge (219) to protect the edge (219) from wear and/or facilitate excavation of materials. Like with the teeth (222) and lip shrouds (224), the wing shrouds (226) and side cutters (228) are configured to be removably attached for replacement as needed.

The outer surfaces of the rear wall (218) and the base wall (212) are appropriately reinforced or provided with wear resistant facing or components. Both the rear wall (218) and the base wall (212) include heel shrouds (232) and wear plates (not visible) fastened along side edges and the outer surface to protect the edges and the surface from wear.

As shown, the sidewalls (216) are substantially planar and the top wall (214) and the base wall (212) curve rearwardly and at least partially define a cylindrical surface together with the rear wall (218). The top wall (214), the base wall (212) and the rear wall (218) are formed from one or more plates suitably pressed to define the respective walls (212, 214, 218).

The containment portion (210) of the bucket (100) includes rounded corners extending between adjacent walls/sidewalls (212, 214, 216, 218).

Figure 4:
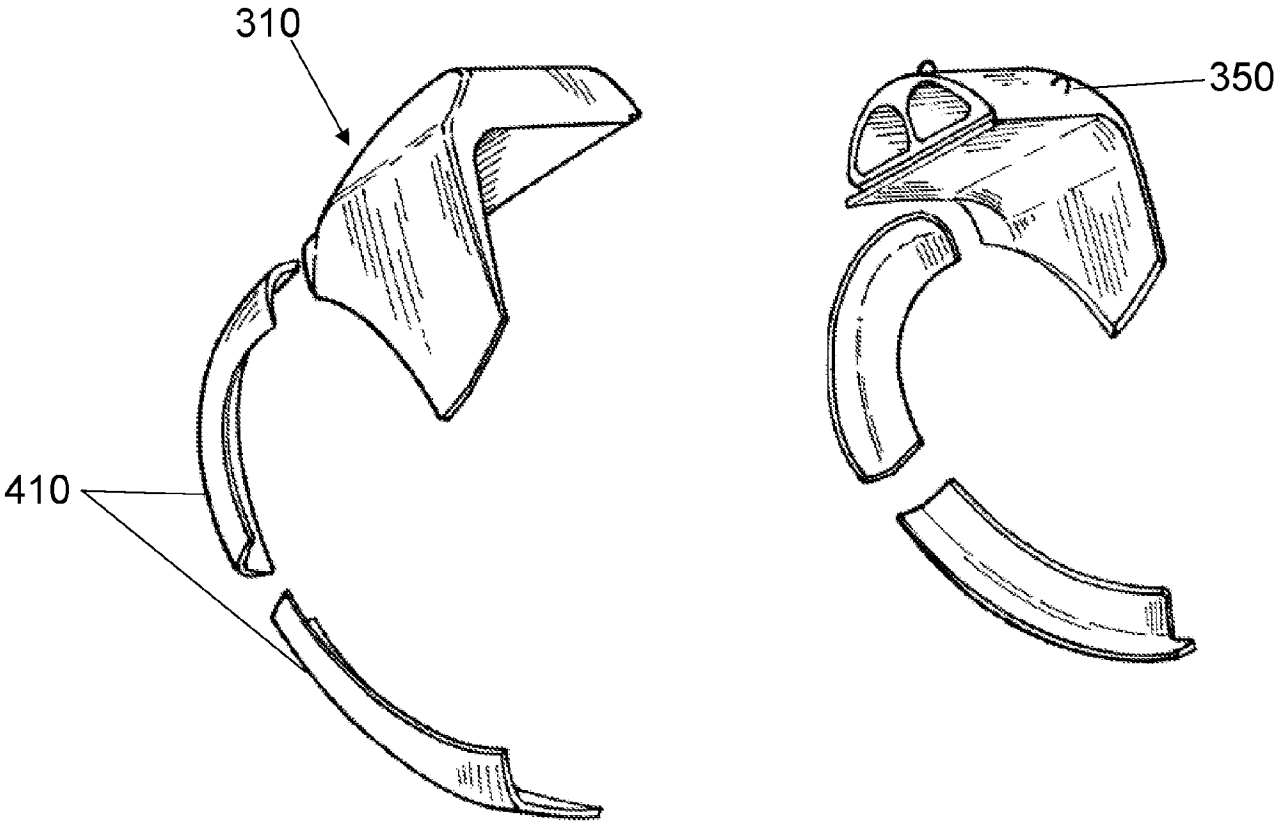
FIG. 4 is a photograph showing the end portions and corner castings of the bucket as shown in FIG. 1.

Referring briefly to FIG. 4, the base wall (212; not shown), the top wall (214; not shown) and the rear wall (218; not shown) join to the sidewalls (216; not shown) via a joining component in the form of a gusset (410) externally welded along and over the respective side edges of the base wall (212; not shown), the top wall (214; not shown), the rear wall (218; not shown) and the sidewall (216; not shown) for forming the join.

Referring back to FIG. 1, the base wall (212), the top wall (214) and the rear wall (218) are formed from one or more plates suitably pressed to define the respective walls (212, 214, 218). The side edges of the one or more plates forming the base wall (212), the top wall (214) and the rear wall (218) are joined together using conventional welding techniques to provide a smooth and flush inner surface minimising any well-defined joins.

In providing the joins as described above, the base wall (212), the top wall (214), the sidewalls (216) and the rear wall (218) advantageously together define a linerless internal containment portion (210).

The attachment portion (110) takes the form of one or more pairs of attachment flanges (112) with an opening (114) defined in each flange (112) for receiving at least one pin therethrough (not shown).

The attachment portion (110) is permanently fastened to the containment portion (210) via the reinforcement formation (300) using conventional welding techniques and extends rearwardly at least partially over the rear wall (218). In such an arrangement, the reinforcing formation (300) reduces stress applied by an associated machine on the bucket (100) and enhances the structural rigidity of the bucket (100).

Figure 2B:
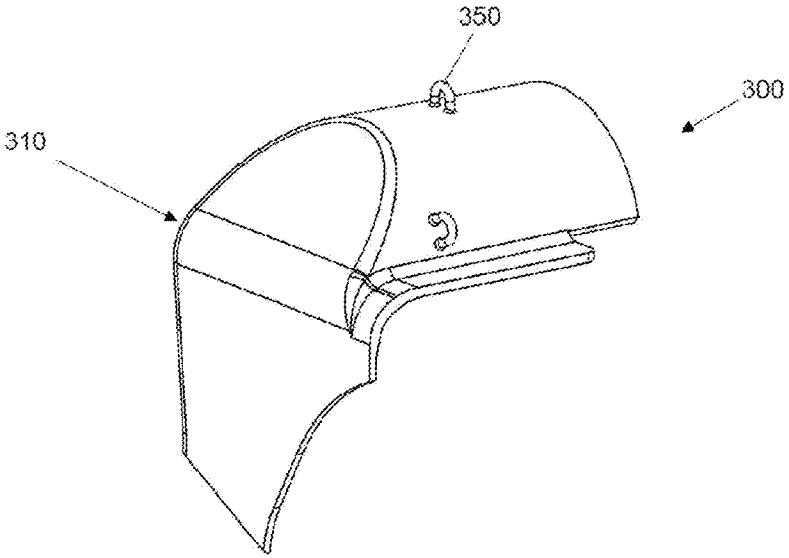
FIGS. 2A and 2B respectively show an upper perspective inner view and an upper perspective outer view of an end portion of the reinforcing formation of the bucket as shown in FIG. 1.
Figure 2A:
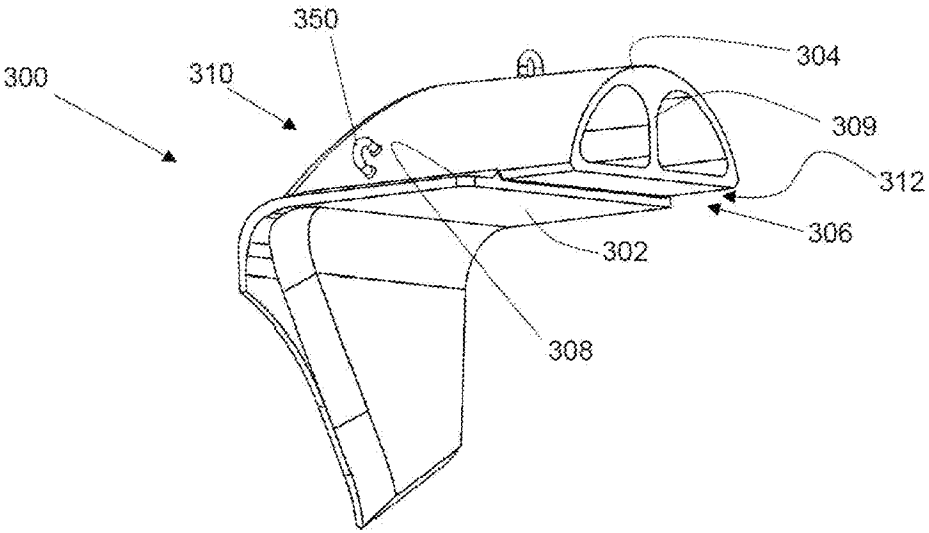
Figure 3:
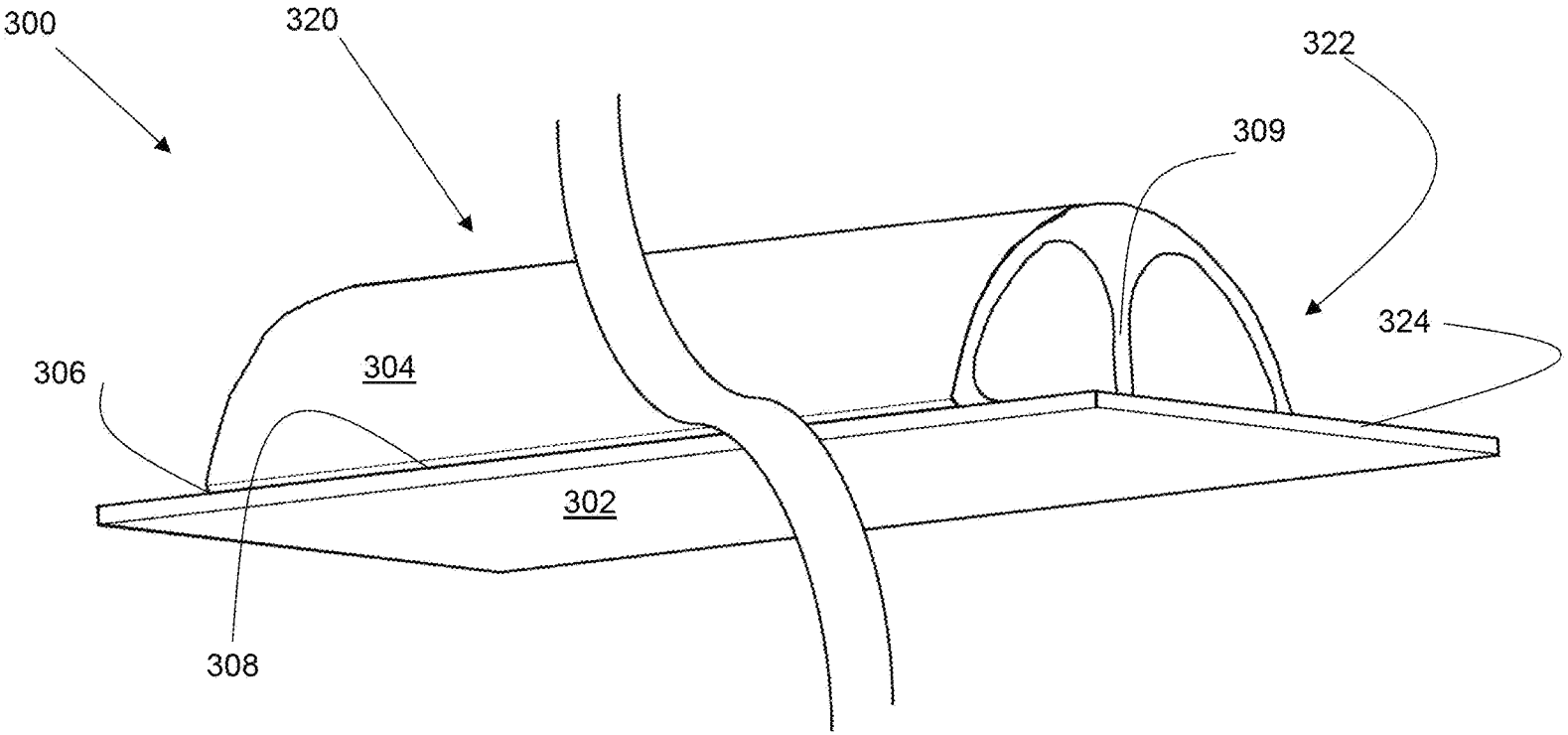
FIG. 3 shows an upper perspective view of a central portion of the reinforcing formation of the bucket as shown in FIG. 1.

FIGS. 2A, 2B and 3 show the reinforcing formation (300) of the present invention.

As previously indicated, the reinforcing formation (300) extends across an outer surface of the top wall (214; not shown) and at least an adjacent portion of each sidewall (116; not shown) of the containment portion (210; not shown) of the bucket (100; not shown).

The reinforcing formation (300) is constructed of hardened steel and is formed from two end portions (310), as shown in FIGS. 2A and 2B, and a central portion (320), shown in FIG. 3, that are assembled in an end-to-end arrangement and permanently joined to the outer surface of the top wall (214; not shown) of the containment portion (210; not shown) using conventional welding techniques.

The reinforcing formation (300) is of tubular construction with a substantially D-shaped cross-section.

Referring to FIGS. 2A and 3, the reinforcing formation (300) includes a bucket abutting wall (302) and an arcuate outer wall (304) interconnected by opposing edges, including opposed end edges (306) and opposed side edges (308) extending longitudinally between the opposed end edges (306).

The bucket abutting wall (302) is substantially planar.

The arcuate outer wall (304) is arcuate in at least one dimension between the opposed side edges (308). The arcuate outer wall (304) may be curved to any degree. For example, the arcuate outer wall (304) may be defined by a constant or uniformly changing radius or some other suitable curve.

Referring to FIGS. 2A and 2B, the end portions (310) of the reinforcing formation (300) have rounded and/or tapered end portions that transition into and at least partially wrap around a corner defined between the top wall (214; not shown) and each sidewall (216; not shown) of the containment portion (210; not shown). In at least partially wrapping around each corner, the reinforcing formation (300) advantageously bolsters the join between the top wall (214; not shown) and each side wall (216; not shown) and enhances the structural rigidity of the bucket (100).

The end portions (310) may be rounded to any degree. For example, the rounded corner defined by each end portion (310) may be defined by a constant or uniformly changing radius or some other suitable curve.

Referring again to both FIGS. 2A and 3, the end portions (310) and central portion (320) of the reinforcing formation (300) each include an internal support member (309) extending between inner surfaces of the bucket abutting wall (302) and the arcuate outer wall (304).

The internal support member (309) extends longitudinally along a length of the reinforcing formation (300) and is centrally positioned, extending between an apex of the arcuate outer wall (304) and a point mid-way between the opposed side edges (308) of the bucket abutting wall (302).

The shape of the reinforcing formation (300) provides many benefits. For example, the radius of curvature of the end portions (310) enhances the structural rigidity of the bucket (100), particular in relation to a join between the top wall (214; not shown) and sidewalls (216; not shown) of the containment portion (210; not shown). The internal support member (309) enhances the strength of the reinforcing formation (300) and the bucket (100) during its highest break out force.

As indicated above, the reinforcing formation (300) is formed from a central portion (320), as shown in FIG. 3, having a pair of opposed ends (322) and configured to extend at least partially across an outer surface of the top wall (214; not shown) and pair of end portions (310), as shown in FIGS. 2A, 2B and 4, each configured to join to an end (322) of the central portion (320) and extend across a portion of the outer surface of the top wall (214; not shown) and at least an adjacent portion of each sidewall (216; not shown) of the containment portion (210; not shown).

As mentioned, the reinforcing formation portions (310, 320) are joined together in an end-to-end arrangement.

Specifically, an end of each end portion (310) includes a recess (312) defined in the bucket abutting wall (302) and each end (322) of the central portion (320) includes a protruding portion (324) of the bucket abutting wall (302) configured to be at least partially received in the recess (312) and at least partially underlie an adjacent end portion (310) when joined together using conventional welding techniques.

Referring to FIGS. 2A, 2B and 4, the end portions (310) of the reinforcing formation (300) further include one or more tether points (350) for use in tethering a load to the bucket (100) and/or handling the bucket (100) when not attached to a machine.

The one or more tether points (350) take the form of a loop protruding outwardly from an outer surface of the end portion (310) of the reinforcing formation (300).

Advantageously, by having the tether points (350) protrude from the end portions (310) of the reinforcing formation (300), stress on the individual tether points and ears of the bucket (100) are reduced thereby enhancing the overall rigidity of the bucket (100).

Figure 6:
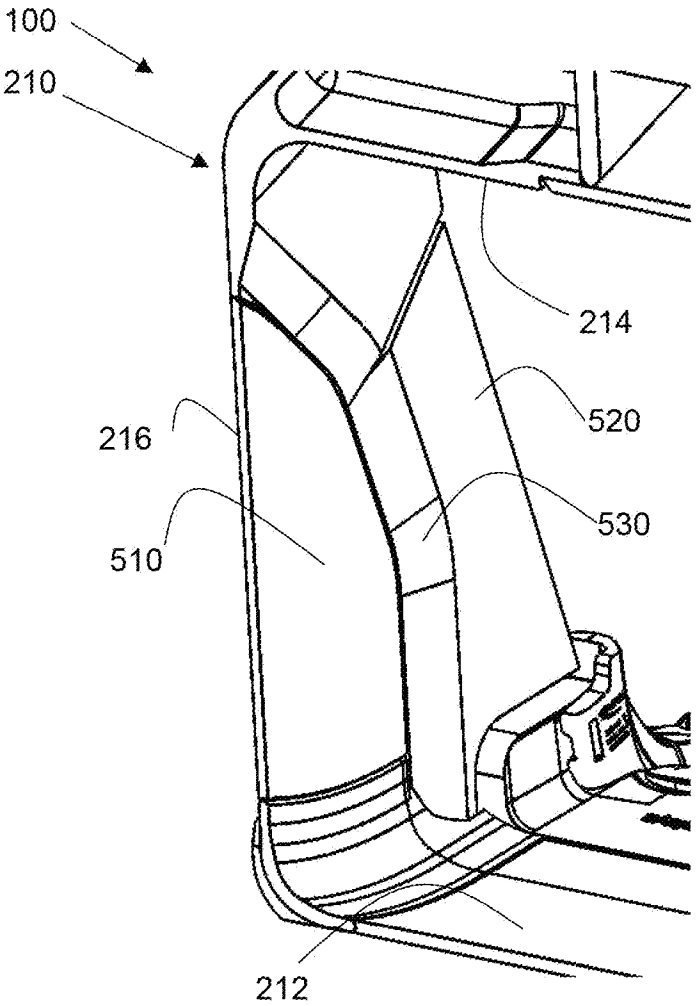
FIG. 6 show a rear sectional perspective view of a sidewall of the bucket as shown in FIG. 1.
Figure 5:
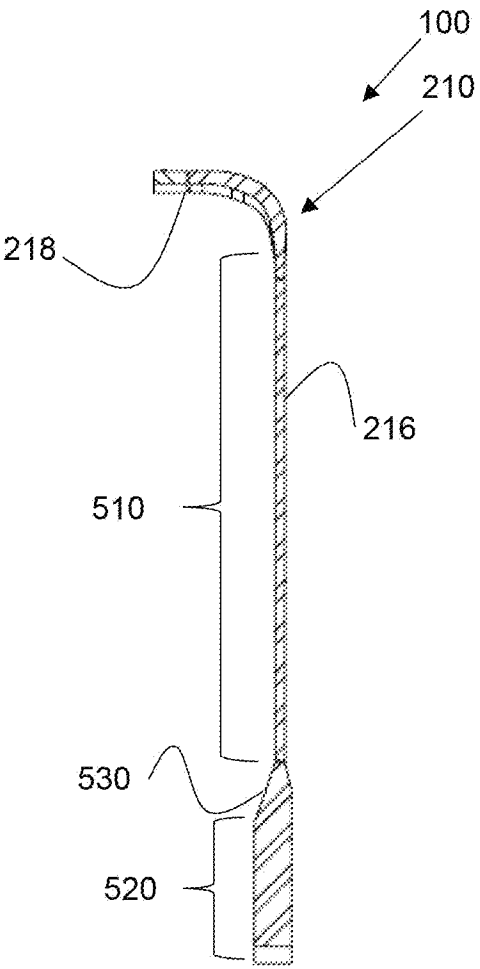
FIG. 5 shows a cross-sectional view of a sidewall of the bucket as shown in FIG. 1.

Referring to FIGS. 5 and 6, each sidewall (216) of the containment portion (210) of the bucket (100) further includes a recessed rear portion (510; i.e., at least one recessed portion) that enhances the rigidity of the sidewalls (216) and increases the capacity of the bucket (100).

The recessed rear portion (510) is located at a rear of each sidewall (216) at and adjacent a join with one or more of the rear wall (218; shown in FIG. 5 only), the base wall (212; shown in FIG. 6 only), and the top wall (214; shown in FIG. 6 only).

Each sidewall (216) further includes a non-recessed portion (520) located at and adjacent the outer edge (219) of each sidewall (216) and a transition (530) between the recessed rear portion (510) and the non-recessed portion (520).

As shown, the transition (530) defines a taper between the recessed rear portion (510) and the non-recessed portion (520) having a gradual and linear gradient.

Advantageously, the recessed rear portion (510) increases the capacity of the containment portion (210) and the fill rate of the bucket (100). Further, the recessed rear portion (520) by expanding at least a rear portion of the sidewalls (216) reduces friction between each sidewall (216) and a load material as the bucket (100) is filled thereby increasing the life of the bucket (100).

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A bucket for use with a machine, said bucket comprising:

an attachment portion for attachment of the bucket to the machine;

a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion; and a reinforcing formation extending across an outer surface of the top wall and at least an adjacent portion of each sidewall of the containment portion, said reinforcing formation having an arcuate shape that transitions into, and at least partially defines, a corner between the top wall and each sidewall to reinforce a join between the top wall and the sidewall and enhance rigidity of the bucket, wherein the reinforcing formation has at least one rounded and tapered side edge portion that transitions into, and at least partially defines a join between the top wall and the rear wall of the containment portion.

2. The bucket of claim 1, wherein the reinforcing formation is of tubular construction with a substantially D-shaped cross-section.

3. The bucket of claim 1, wherein the reinforcing formation comprises a bucket abutting wall and an arcuate outer wall interconnected by opposing edges.

4. The bucket of claim 3, wherein an outer surface of the bucket abutting wall is configured to be attached to an outer surface of the top wall of the containment portion.

5. The bucket of claim 1, wherein the reinforcing formation has rounded and tapered end portions that transition into and at least partially wrap around the corner defined between the top wall and each sidewall of the containment portion of the bucket.

6. The bucket of claim 3, wherein the reinforcing formation comprises at least one internal support member extending between inner surfaces of the bucket abutting wall and the arcuate outer wall.

7. The bucket of claim 6, wherein the at least one internal support member extends longitudinally at least partially along a length of the reinforcing formation.

8. The bucket of claim 6, wherein the at least one internal support member extends continuously along a length of the reinforcing formation.

9. The bucket of claim 6, wherein the at least one internal support member comprises a plurality of internal support members extending longitudinally at periodic intervals along a length of the reinforcing formation.

10. The bucket of claim 1, wherein the reinforcing formation is formed from two or more reinforcing formation portions joined together longitudinally in an end-to-end arrangement.

11. The bucket of claim 1, wherein the reinforcing formation comprises:

a central portion having a pair of opposed ends and configured to extend at least partially across an outer surface of the top wall; and a pair of end portions each configured to join to an end of the central portion and extend across a portion of the outer surface of the top wall and at least an adjacent portion of each sidewall of the containment portion.

12. The bucket of claim 1, further comprising one or more tether points for tethering a load to the bucket and handling the bucket when not attached to a machine.

13. The bucket of claim 1, wherein both sidewalls of the containment portion further comprise at least one recessed portion for providing the sidewalls with greater rigidity.

14. The bucket of claim 13, wherein the recessed portion is defined on the inner surface of each said sidewall near a rear of said sidewall adjacent a join with one or more of the rear wall, the base wall and the top wall.

15. A method of constructing a bucket in accordance with claim 1, said method comprising:

forming at least one plate member to define the top wall, the rear wall and the bottom wall of the bucket;

joining side plates to outer side edges of the at least one plate member to define the sidewalls of the bucket; and attaching the reinforcing formation to an outer surface of the top wall such that it extends across an outer surface of the top wall and at least an adjacent portion of each sidewall of the containment portion and transitions into, and at least partially defines, the corner between the top wall and each sidewall to reinforce the join between the top wall and the sidewall and enhance rigidity of the bucket.

16. The method of claim 15, wherein the attaching comprises attaching the reinforcing formation to the outer surface of the top wall and at least a portion of each side wall in a surface-to-surface arrangement.

17. A bucket for use with a machine, said bucket comprising:

an attachment portion for attachment of the bucket to the machine;

a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion; and a reinforcing formation extending across an outer surface of the top wall and at least an adjacent portion of each sidewall of the containment portion, said reinforcing formation having an arcuate shape that transitions into, and at least partially defines, a corner between the top wall and each sidewall to reinforce a join between the top wall and the sidewall and enhance rigidity of the bucket, wherein the reinforcing formation comprises a bucket abutting wall and an arcuate outer wall interconnected by opposing edges, and at least one internal support member extending between inner surfaces of the bucket abutting wall and the arcuate outer wall, said at least one internal support member being centrally positioned extending between an apex of the arcuate outer wall and a point mid-way between the opposed side edges of the bucket abutting wall.

18. A bucket for use with a machine, said bucket comprising:

an attachment portion for attachment of the bucket to the machine;

a containment portion mounted to the attachment portion, said containment portion defined by a base wall, an opposed top wall, a pair of opposed sidewalls and a rear wall, each of the base wall, the top wall and the opposed sidewalls having an outer edge and extending from the rear wall to the outer edge to define an opening to the containment portion; and a reinforcing formation extending across an outer surface of the top wall and at least an adjacent portion of each sidewall of the containment portion, said reinforcing formation having an arcuate shape that transitions into, and at least partially defines, a corner between the top wall and each sidewall to reinforce a join between the top wall and the sidewall and enhance rigidity of the bucket, wherein the reinforcing formation comprises a bucket abutting wall and an arcuate outer wall interconnected by opposing edges; a central portion having a pair of opposed ends and configured to extend at least partially across an outer surface of the top wall; and a pair of end portions each configured to join to an end of the central portion and extend across a portion of the outer surface of the top wall and at least an adjacent portion of each sidewall of the containment portion, and wherein each of the pair of end portions comprises a recess defined in the bucket abutting wall and each of the opposed ends of the central portion comprises a protruding portion of the bucket abutting wall, said protruding portion configured to be at least partially received in the recess and at least partially underlie an adjacent end portion when joined together.

* * * * *